US006619375B2

(12) United States Patent
Hohenbichler et al.

(10) Patent No.: US 6,619,375 B2
(45) Date of Patent: Sep. 16, 2003

(54) CASTING ROLL

(75) Inventors: Gerald Hohenbichler, Kronstorf (AT); Armin Schertler, Guntramsdorf (AT); Thomas Reiter, Gmunden (AT); Günther Staudinger, Gmunden (AT)

(73) Assignee: Voest-Alpine Industrieanlagenbau GmbH, Linz (AT)

( * ) Notice: Subject to any disclaimer, the term of this patent is extended or adjusted under 35 U.S.C. 154(b) by 18 days.

(21) Appl. No.: 10/085,019

(22) Filed: Mar. 1, 2002

(65) Prior Publication Data

US 2002/0112841 A1 Aug. 22, 2002

Related U.S. Application Data

(63) Continuation of application No. PCT/AT00/00234, filed on Aug. 30, 2000.

(30) Foreign Application Priority Data

Sep. 6, 1999 (AT) ..... 1527/99

(51) Int. Cl.[7] ..... B22D 11/04

(52) U.S. Cl. ..... 164/435; 164/429; 164/442; 164/448

(58) Field of Search ..... 164/479, 480, 164/427, 428, 429, 435, 448, 442

(56) References Cited

U.S. PATENT DOCUMENTS 5,207,265 A * 5/1993 Hasegawa et al. ..... 164/428
5,613,546 A 3/1997 Delassus et al.
5,638,891 A * 6/1997 Fukase et al. ..... 164/448
5,839,501 A 11/1998 Delassus et al.

FOREIGN PATENT DOCUMENTS

| | | | |
|---|---|---|---|
| DE | 3839110 A1 | | 6/1989 |
| DE | 3836886 A1 | * | 5/1990 |
| DE | 4203964 A1 | | 8/1992 |
| EP | 0427574 A1 | | 5/1991 |
| EP | 0664173 A1 | | 7/1995 |
| JP | 60-27446 | | 2/1985 |
| JP | 60-127007 | | 7/1985 |

* cited by examiner

*Primary Examiner*—M. Alexandra Elve
*Assistant Examiner*—Kevin McHenry
(74) *Attorney, Agent, or Firm*—Dickstein Shapiro Morin & Oshinsky, LLP

(57) ABSTRACT

In a casting roll for a thin strip casting plant, comprising an essentially cylindrical core (1), a mantle (2) of copper or a copper alloy optionally being provided with at least one outside layer (5), an internal cooling system (4) as well as an adjusting means (8, 17, 20) for adjusting the outline of the casting roll in its front-end regions (7), the adjusting means for the purpose of levelling out thermally caused crowns with the aid of constructively simple means has in each front-end region of the casting roll a supporting disk (17) adjustable in the longitudinal direction of the casting roll and engaging a ring (8) radially surrounding the supporting disk (17) and abutting the mantle (2) from the inside in its front-end regions, which ring is fixedly attached with regard to the core (1) in the longitudinal direction of the casting roll (Fig.).

11 Claims, 1 Drawing Sheet

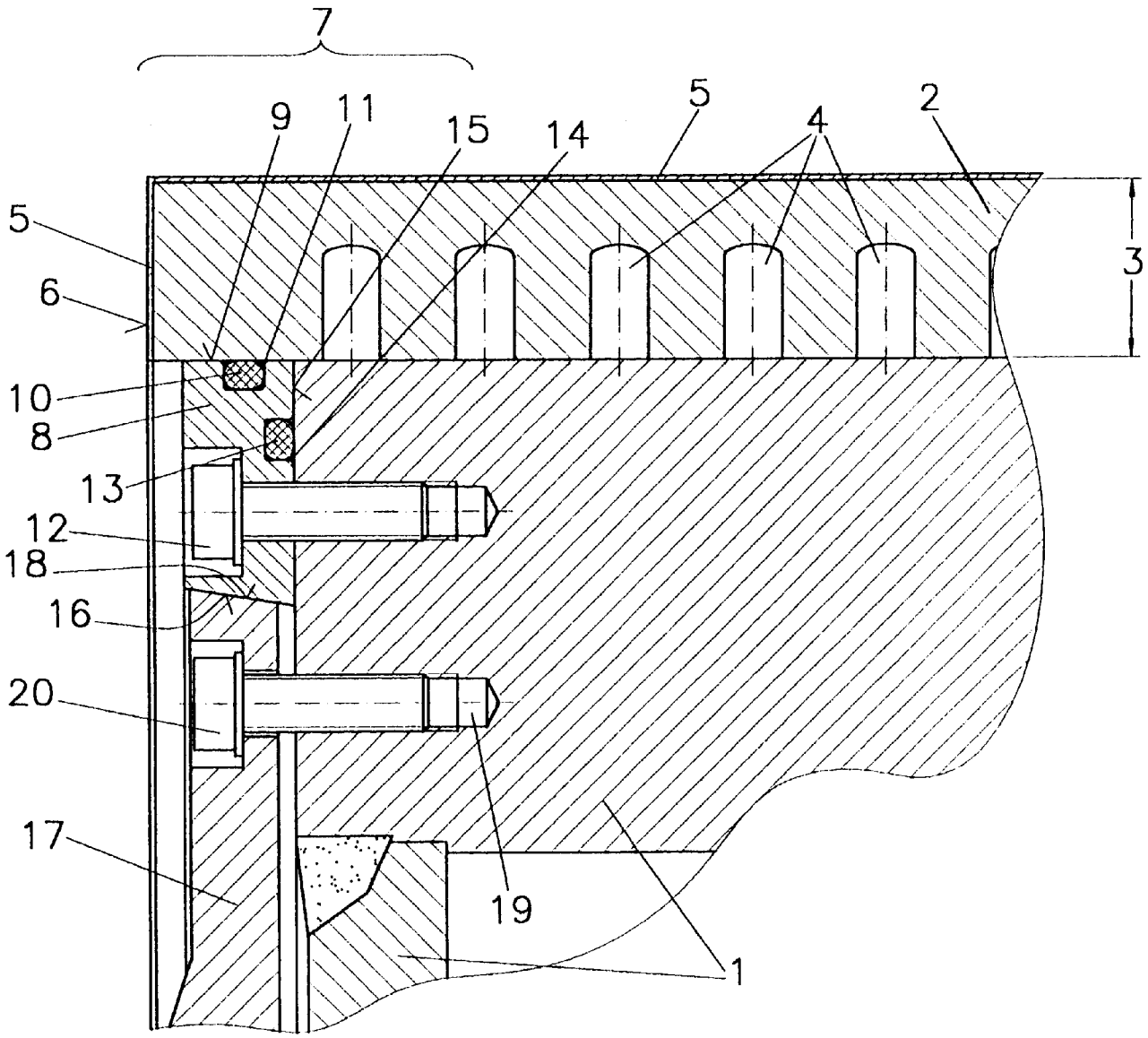
3
2
4
5
14
15
11
9
7
5
6
10
8
13
12
18
16
20
17
19
1

CASTING ROLL

This is a continuation of application No. PCT/AT00/00234 filed Aug. 30, 2000.

BACKGROUND OF THE INVENTION

The invention relates to a casting roll for a thin strip casting plant, in particular for the continuous casting of thin strips of steel, comprising an essentially cylindrical core, a mantle of copper or a copper alloy optionally being provided with at least one outside layer, an internal cooling system as well as an adjusting means for adjusting the outline of the casting roll in its front-end regions.

A casting roll of this kind is known f.i. from EP-A-0 664 173. Casting rolls of this kind are used for continuously casting refractory metals such as steel. Here, two casting rolls of this kind are arranged parallel to each other and turned in opposite directions around their respective axes. The metal melt is cast into a slit defined between the casting rolls and is cooled and solidified when in contact with the surfaces of the casting rolls provided with an internal cooling system and when passing through the slit, so that the metal emerges from the casting slit in the form of an essentially solidified strip. The thickness of the strip is determined by the width of the casting slit and the width of the strip is determined by the length of the casting slit, which is limited at its ends by sealing surfaces adjacent to the fronts of the casting rolls.

Here, the problem of curvatures of the surfaces of the casting rolls arises, that is, a deviation of the surfaces of the casting rolls from the desired strictly cylindrical or slightly crowned form. The reason for this is to be seen in thermally caused deformations of the mantles of the casting rolls subject to very high temperatures.

In order to reduce the crown of the rolls, which occurs in continuous casting, and/or to control the crown of the rolls, it is known (JP-A-60-27446) to provide conically tapered pistons in the casting rolls. These conically tapered pistons are lodged in a displaceable manner in two piston sliding spaces arranged at the opposite ends of the casting roll, respectively, so that by displacing the conically tapered piston in the axial direction, the outer circumferential surface of the casting roll is deformed by the wedge-like effect of the conically tapered piston. However, it can not be avoided here that the pistons, seen depending on the position in the piston sliding spaces at different sites in the longitudinal direction of the casting roll, exercise forces on the casting roll, i.e. the mantle of the casting roll, whereby it is very difficult—if it is possible at all—to exactly level out the crown of the roll.

Especially in the front-end regions of the casting rolls, the high specific heat flows, which occur in the solidification process when thin-strip-casting, result in specific thermal strains and stresses, whereby here, higher strip thicknesses result than in the center region of a cast strip. Instead of the required concave profile, the strip has a profile of a locally substantially convex form. It is true that attempts have been made to remedy this by way of a precompensation, namely by forming a concave casting-roll profile, but this was helpful only to a limited extent, due to the dependence on the generally set strip thickness, the casting rate, the height of the bath level and other parameters having an influence on the solidification and heat elimination, such as quality of the steel, temperature of the melt, etc.

From the above EP-A-0 664 173 it is known to support the front-end regions of the casting-roll mantle by means of ring-shaped hollow supporting bodies at the core and to conduct hot water through the hollow spaces of the ring-shaped hollow bodies, so that thermal strains caused hereby are transferred to the mantle and deform it, giving it the desired profile. However, a construction of this kind results in that the casting roll becomes very complex, given that it is necessary to provide two different water cycles, namely on the one hand the hot-water cycle for levelling out the thermally caused deformations and on the other hand a cooling-water cycle for eliminating the heat released by the metal which is solidifying. Accordingly, a casting roll of this kind is expensive, and it involves many risks with respect to the rough casting operations in a steel mill.

The inventions has as its objects to avoid these disadvantages and difficulties and to develop a casting roll of the above kind by means of which thermal crowns may be reduced and/or completely levelled out with the aid of constructively simple means. In particular, the casting roll should be robust enough for continuous operation and little susceptible to trouble. Furthermore, building the construction should be cheap, and the construction should ensure a simple operation.

In the case of a casting roll of the above kind, this object is achieved with the adjusting means having in each front-end region of the casting roll a supporting disk adjustable in the longitudinal direction of the casting roll and engaging a ring radially surrounding the supporting disk and abutting the mantle from the inside in its front-end regions, which ring is fixedly attached with regard to the core in the longitudinal direction of the casting roll.

For a casting roll, a supporting disk as such is known from U.S. Pat. No. 5,613,546, but this supporting disk directly engages the mantle of the casting roll and does not provide for levelling out thermal crowns but for centering the mantle with regard to the core.

According to a preferred embodiment, the ring is sealed against the mantle as well as the core by means of a gasket. Hereby, an absolute impermeability of the internal cooling system of the casting roll is ensured. In a construction according to JP-A-60-27446, f.i., such an impermeability is not a matter of course. In this known construction, the conically tapered pistons are provided within the core and, on the outside, surrounded by the cooling system for the mantle. Hereby, a widening of the mantle by means of the pistons results in a radial displacement of the supply and discharge ducts of the internal cooling system of the mantle.

In its outer circumferential surface, the supporting disk is preferably furnished with a frustoconical surface abutting a counter-frustoconical surface provided at the ring in its inner circumferential surface.

An embodiment which is constructively easy to build and safe in operation is characterized in that for the adjustment of the supporting disk in the longitudinal direction of the casting roll, a plurality of bolts distributed close to the outer circumference of the supporting disk is provided, by the aid of which bolts the supporting disk is adjustable against the core, wherein preferably the bolts are screwed into blind holes arranged at the core. Here, the setting of the supporting disks is effected before beginning to cast.

A further preferred embodiment is characterized in that the supporting disk is adjustable by means of a ring nut against the core in the longitudinal direction of the casting roll.

In order to be able to effect an adjustment during the strip-casting, according to another preferred embodiment the supporting disk is hydraulically adjustable against the core in the longitudinal direction of the casting roll.

Suitably, the ring extends up to a maximum of 75 mm from the front-end region in the longitudinal direction of the casting roll to its center, preferably up to 50 mm, in particular up to 35 mm.

Preferably, the mantle has a thickness less than or equal to 50 mm in its front-end regions, where contact with the ring occurs.

BRIEF DESCRIPTION OF THE DRAWING

In the following, the invention is explained in more detail by means of an exemplary embodiment shown in the drawing, the FIGURE contained in the drawing illustrating an axial section through a casting roll.

DETAILED DESCRIPTION OF THE INVENTION

Referring to the drawing, reference numeral 1 refers to a steel drum which constitutes the core of the casting roll. The steel drum 1 and/or the core 1 is provided with ports for a coolant that can be axially supplied and discharged. On the outside, this core 1 is surrounded by a mantle 2 of copper or a copper alloy, the thickness 3 of the mantle being between 40 and 45 mm. On the inside, the mantle 2 has coolant channels 4 through which coolant flows, so that an intensive heat elimination via the mantle 2 is possible.

The length of the casting roll is about 1 to 2 m. At present, preferably casting rolls having lengths of 1100 to 1600 mm are built.

On the outside, the mantle is provided with a nickel or chromium layer 5. This layer 5 also extends beyond the fronts 6 of the mantle. The front-end regions 7 of the mantle 2 project beyond the steel drum and/or the core 1 in the longitudinal direction of the casting roll, and that for up to a maximum of 75 mm, preferably for less than 50 mm. In this projecting region 7 a ring 8 abuts the mantle 2 from the inside, wherein a gasket 10 is provided between the outer circumferential surface 9 of the ring 8 and the mantle 2, which gasket is lodged in a circumferential groove 11 of the ring 8.

Moreover, the ring 8 is fixed to the core 1 in the axial direction of the casting roll by means of bolts 12 and is sealed against the core 1 by means of another gasket 13 lodged in a ring groove 14 on an inner side face 15 of the ring 8, so that coolant which flows via the core 1 to the coolant channels 4 of the mantle 2 and back again to the core 1 is prevented from emerging from the casting roll.

The inner circumferential side 16 of the ring 8, which is directed at the axis of rotation, is of frustoconical design, namely tapering in the direction of the center of the casting roll. Adjacent to this frustoconical surface 16 is a ring-shaped supporting disk 17 having an outer circumferential surface 18 which also is of frustoconical design, namely diametrically opposed to the frustoconical surface 16 of the ring 8. In the illustrated exemplary embodiment, this supporting disk 17 is adjustable in the axial direction of the casting roll by means of several bolts 20 screwed into blind holes 19 of the core 1, whereby a widening of the ring 8 and, by that, a widening of the front-end region 7 of the mantle 2 occur to the desired extent. The bolts 20 are provided close to the outer circumference of the ring-shaped supporting disk 17 so as to avoid bends and/or bulges of the supporting disk 17.

As results directly from this described and illustrated construction, displacing and/or adjusting the supporting disk 17 only widens the adjacent ring 8 without changing its axial position with regard to the core 1. In order to ensure a widening, i.e. an elongation in the radial direction and/or circumferential direction of the ring 8, the bolts 12 by which the ring is attached to the core 1 are only tightened to such an extent that an impermeability between the ring 8 and the core 1 is ensured, wherein, however, a sliding of the inner side face 15 of the ring 8, which abuts the outer front surface of the core 1, is possible when a major force is applied.

A particular advantage of the inventive construction is to be seen in that setting the profile of the casting-roll generatrix as a function of the planned and/or current casting and/or solidification conditions is allowed, so that the respective appropriate and/or still acceptable strip-thickness transverse section may be generated in the edge region without requiring complex machining processes such as turning and grinding. Especially in the case of a very hard thin surface layer 5 such as a chromium layer on the mantle 2, this is a great advantage, given that each machining profile setting would also require a new layer on the mantle 2. In addition, a machining profile setting would require periods of standstill of the plant, in order to be able to carry out the necessary replacements of the casting rolls. Furthermore, several pairs of castings rolls would have to be stocked. Thus, according to the invention, investment and storage costs are lower, the same as the part of standstill periods of the plant.

What is claimed is:

1. Casting roll for a thin strip casting plant, in particular for the continuous casting of thin strips of steel, comprising an essentially cylindrical core (1), a mantle (2) of copper or a copper alloy optionally being provided with a least one outside layer (5), an internal cooling system (4) as well as an adjusting means (8, 17, 20) for adjusting the outline of the casting roll in its front-end regions (7), characterized in that, in each front-end region of the casting roll, the adjusting means is furnished with a supporting disk (17) adjustable in the longitudinal direction of the casting roll and engaging a ring (8) radially surrounding the supporting disk (17) and abutting the mantle (2) from the inside in its front-end regions, which ring is fixedly attached with regard to the core (1) in the longitudinal direction of the casting roll.

2. Casting roll according to claim 1, characterized in that, by means of a gasket (10, 13), the ring (8) is sealed against the mantle (2) as well as the core (1).

3. Casting roll according to claim 1, characterized in that, in its outer circumferential surface, the supporting disk (17) is furnished with a frustoconical surface (18) abutting a counter-frustoconical surface provided at the ring (8) in its inner circumferential surface (16).

4. Casting roll according to claim 1, characterized in that, for the adjustment of the supporting disk (17) in the longitudinal direction of the casting roll, a plurality of bolts (20) distributed close to the outer circumference of the supporting disk (17) is provided, by the aid of which bolts the supporting disk (17) is adjustable against the core (1).

5. Casting roll according to claim 4, characterized in that the bolts are screwed into blind holes (19) arranged at the core (1).

6. Casting roll according to claim 1, characterized in that, by means of a ring nut, the supporting disk (17) is adjustable against the core (1) in the longitudinal direction of the casting roll.

7. Casting roll according to claim 1, characterized in that the supporting disk (17) is hydraulically adjustable against the core (1) in the longitudinal direction of the casting roll.

8. Casting roll according to claim 1, characterized in that the ring (8) extends from the front-end region in the longitudinal direction of the casting roll to its center for up to 75 mm.

9. Casting roll according to claim 8, characterized in that the ring (8) extends from the front-end region in the longitudinal direction of the casting roll to its center for up to 50 mm.

10. Casting roll according to claim 8, characterized in that the ring (8) extends from the front-end region in the longitudinal direction of the casting roll to its center for up to 35 mm.

11. Casting roll according to claim 7, characterized in that the mantle (2) has a thickness of less than or equal to 50 mm in its front-end regions (7), where contact with the ring (8) occurs.

* * * * *